US010074929B2

(12) United States Patent
Il et al.

(10) Patent No.: US 10,074,929 B2
(45) Date of Patent: Sep. 11, 2018

(54) WATER-STOP STRUCTURE FOR CONNECTOR

(71) Applicant: YAZAKI CORPORATION, Tokyo (JP)

(72) Inventors: Ryosuke Il, Shizuoka (JP); Atsuhito Saito, Shizuoka (JP); Shinichi Ikemoto, Kanagawa (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/146,001

(22) Filed: May 4, 2016

(65) Prior Publication Data

US 2016/0248194 A1 Aug. 25, 2016

Related U.S. Application Data

(63) Continuation of application No. PCT/JP2014/079164, filed on Nov. 4, 2014.

(30) Foreign Application Priority Data

Nov. 7, 2013 (JP) ..... 2013-231180

(51) Int. Cl.
*H01R 13/52* (2006.01)
*H01R 13/422* (2006.01)

(52) U.S. Cl.
CPC ..... *H01R 13/5205* (2013.01); *H01R 13/4223* (2013.01)

(58) Field of Classification Search
CPC ..... H01R 13/5205; H01R 13/5208; H01R 4/185; H01R 2201/26; H01R 43/005;
(Continued)

(56) References Cited

U.S. PATENT DOCUMENTS 4,214,802 A 7/1980 Otani et al.
5,651,692 A * 7/1997 Hatagishi ..... H01R 13/5829 439/459

(Continued)

FOREIGN PATENT DOCUMENTS

CN 103022780 A 4/2013
CN 103229359 A 7/2013

(Continued)

OTHER PUBLICATIONS

International Search Report of PCT/JP2014/079164 dated Feb. 3, 2015.

(Continued)

*Primary Examiner* — Truc Nguyen
(74) *Attorney, Agent, or Firm* — Sughrue Mion, PLLC

(57) ABSTRACT

A water-stop structure (1) for a connector has: a terminal (5) including a mating terminal connecting portion (13), a wire barrel portion (17), and an insulation barrel portion (19); an electric wire (7) installed on the terminal (5) in such a manner that a sheath (25) is removed to expose a core wire (23) at one end portion, the exposed core wire (23) is held by the wire barrel portion (17), and a portion of the sheath (25) near the exposed core wire (23) is held by the insulation barrel portion (19); and a sealing body (9) integrally provided on the electric wire (7) and the terminal (5) so as to cover at least the insulation barrel portion (19).

7 Claims, 5 Drawing Sheets

(58) Field of Classification Search
CPC ..... H01R 13/4223; H01R 13/52; H01R 13/5202; H01R 13/5219; H01R 4/70; H01R 13/5216; H01R 13/6273; H01R 13/641; H01R 13/648
See application file for complete search history.

(56) References Cited

U.S. PATENT DOCUMENTS

| | | | | |
|---|---|---|---|---|
| 5,879,192 | A * | 3/1999 | Machida | H01R 13/4367 439/598 |
| 2004/0248449 | A1* | 12/2004 | Martin | H01R 13/4223 439/272 |
| 2005/0221672 | A1* | 10/2005 | Tsuchjya | H01R 13/4223 439/587 |
| 2006/0003631 | A1* | 1/2006 | Fukatsu | H01R 13/4364 439/595 |
| 2006/0141862 | A1* | 6/2006 | Machida | H01R 13/4223 439/595 |
| 2007/0293101 | A1* | 12/2007 | Lamdiziz | H01R 13/4368 439/816 |
| 2008/0096414 | A1* | 4/2008 | Hiramatsu | H01R 13/627 439/370 |
| 2008/0108241 | A1* | 5/2008 | Kocher | H01R 4/26 439/345 |
| 2008/0160813 | A1* | 7/2008 | Itou | H01R 13/5208 439/279 |
| 2009/0098779 | A1* | 4/2009 | Kawamura | H01R 9/032 439/733.1 |
| 2010/0075523 | A1* | 3/2010 | Saitou | H01R 13/5205 439/273 |
| 2011/0086545 | A1* | 4/2011 | Ishida | H01R 13/5208 439/587 |
| 2012/0295493 | A1* | 11/2012 | Hirabayashi | H01R 13/113 439/817 |
| 2013/0072061 | A1 | 3/2013 | Morikawa | |
| 2013/0252459 | A1* | 9/2013 | Tanaka | H01R 4/185 439/523 |
| 2013/0252481 | A1* | 9/2013 | Sato | H01R 4/70 439/736 |
| 2013/0280942 | A1* | 10/2013 | Muro | H01R 13/6272 439/345 |
| 2013/0303019 | A1* | 11/2013 | Ito | H01R 13/533 439/521 |
| 2013/0323958 | A1* | 12/2013 | Nakashima | H01R 13/6272 439/350 |
| 2014/0194002 | A1* | 7/2014 | Sato | H01R 4/70 439/589 |
| 2015/0099386 | A1* | 4/2015 | Morello | H01R 13/6272 439/310 |
| 2015/0229059 | A1* | 8/2015 | Itou | H01R 11/283 439/733.1 |
| 2016/0156113 | A1 | 6/2016 | Tanaka et al. | |

FOREIGN PATENT DOCUMENTS

| | | | |
|---|---|---|---|
| CN | 103262349 | A | 8/2013 |
| JP | 50-56984 | | 5/1975 |
| JP | 54-98987 | A | 8/1979 |
| JP | 9-92385 | A | 4/1997 |
| JP | 2001-176594 | A | 6/2001 |
| JP | 2011-014420 | A | 1/2011 |
| JP | 2011-014421 | A | 1/2011 |
| JP | 2012-059438 | A | 3/2012 |
| JP | 2012-79654 | A | 4/2012 |
| JP | 2012-129178 | A | 7/2012 |
| JP | 2013-65525 | A | 4/2013 |
| WO | 2012/032823 | A1 | 3/2012 |

OTHER PUBLICATIONS

Communication dated May 2, 2017 from the State Intellectual Property Office of the P.R.C. in counterpart application No. 201480061074.4.
Communication dated Oct. 30, 2017, from the State Intellectual Property Office of People's Republic of China in counterpart Application No. 201480061074.4.
Communication dated Feb. 13, 2018, from the Japanese Patent Office in counterpart application No. 2013-231180.
Communication dated Aug. 1, 2017, issued by the Japanese Patent Office in counterpart application No. 2013-231180.
Communication dated May 3, 2018 issued by the State Intellectual Property Office of People's Republic of China in counterpart Application No. 201480061074.4 English Translation.

* cited by examiner

WATER-STOP STRUCTURE FOR CONNECTOR

CROSS REFERENCE TO RELATED APPLICATIONS

This application is a Continuation of PCT Application No. PCT/JP2014/079164, filed on Nov. 4, 2014, and claims the priority of Japanese Patent Application No. 2013-231180, filed on Nov. 7, 2013, the content of both of which is incorporated herein by reference.

BACKGROUND

Technical Field

The present invention relates to a water-stop structure for a connector, and particularly to a water-stop structure in which a sealing body is provided on a terminal and electric wires.

Related Art

Conventionally, a water-stop structure for connector (waterproof connector) 301 as illustrated in FIG. 1 is known (see JP 2012-59438 A).

The water-stop structure for connector 301 is provided with a connector housing 305 including a cavity 303, a terminal fitting 307 inserted into the cavity 303, and a sealing member 309 being in close contact with the terminal fitting 307. The terminal fitting 307 includes a main body portion connected to a mating terminal fitting and an electric wire connecting portion 315 connected to a core wire 313 in an end portion of an electric wire 311. The sealing member 309 is in close contact with the electric wire connecting portion 315 while covering the core wire 313.

In addition, the connector housing 305 includes a first connector housing 317 and a second connector housing 319. The sealing member 309 is in contact with the inner side of the first connector housing 317 in the radial direction, and is held between the first connector housing 317 and the second connector housing 319 in the axial direction. As a result, the sealing member 309 is fixed to the connector housing 305.

According to the water-stop structure for connector 301, the sealing member 309 is in close contact with the electric wire connecting portion 315 while covering the core wire 313. Therefore, a connecting portion between the electric wire connecting portion 315 and the core wire 313 is liquid-tightly sealed. As a result, the connection reliability between the electric wire 311 and the terminal fitting 307 is secured.

Moreover, conventionally, a water-stop structure for connector (rubber plug holding structure of a crimp terminal) 351 as illustrated in FIGS. 2 to 4 is known (see JP 2011-14420 A and JP 2011-14421 A).

The water-stop structure for connector 351 is provided with a connector housing 355 including a cavity 353, a crimp terminal (terminal fitting) 357 inserted into the cavity 353, and a rubber plug (sealing member) 359.

In addition, in the water-stop structure for connector 351, a pair of rubber plug caulking pieces 361*a* and 361*b* formed on the crimp terminal 357 is caulked and thus, an electric wire 363 and the rubber plug 359 are fixed to the crimp terminal 357.

SUMMARY OF THE INVENTION

In the water-stop structure for connector 301 described in JP 2012-59438 A, as described above, the connector housing 305 includes two members, i.e., the first connector housing 317 and the second connector housing 319. The sealing member 309 is held between the first connector housing 317 and the second connector housing 319 in the axial direction (fitting direction of a terminal which is the left-right direction in FIG. 1). As a result, the sealing member 309 is fixed to the connector housing 305. This causes a problem that a dimension LA of the terminal fitting 307 in the fitting direction, as illustrated in FIG. 1, increases in length by a dimension LB or a dimension LC, for example.

Moreover, in the water-stop structure for connector 351 described in JP 2011-14420 A and JP 2011-14421 A, the pair of rubber plug caulking pieces 361*a* and 361*b* formed on the terminal 357 is caulked and thus, the electric wire 363 and the rubber plug 359 are fixed to the terminal 357. This causes a problem that a dimension LD of the terminal 357 in the fitting direction, as illustrated in FIGS. 3 and 4, increases in length by a dimension LE, for example.

The present invention has been made in view of the above, and an object thereof is to provide a water-stop structure for a connector that can shorten the dimension of a terminal in the fitting direction in comparison with the related art.

A water-stop structure for a connector according to the present invention has a terminal including a mating terminal connecting portion, a wire barrel portion, and an insulation barrel portion, an electric wire installed on the terminal in such a manner that a sheath is removed to expose a core wire at one end portion, the exposed core wire is held by the wire barrel portion, and a portion of the sheath near the exposed core wire is held by the insulation barrel portion, and a sealing body integrally provided on the electric wire and the terminal so as to cover at least the insulation barrel portion.

The water-stop structure for a connector according to the present invention may have a housing provided with a cavity into which the terminal is inserted and accommodated, and a lance that is provided in the housing, and engages with the terminal accommodated in the cavity to retain the terminal. The lance may be formed in a cantilevered manner, a base end of the lance is positioned at the front side in the insertion direction of the terminal, a tip end of the lance is positioned at the rear side in the insertion direction of the terminal, and a locking portion provided on the side of the tip end engages with the mating terminal connecting portion of the terminal accommodated in the cavity so as to retain the terminal.

The water-stop structure for a connector according to the present invention may have the sealing body integrally provided on the electric wire and the terminal, at a portion from the wire barrel portion to the electric wire near the insulation barrel portion, so as to cover the wire barrel portion, the insulation barrel portion, and a part of the electric wire.

According to the present invention, a water-stop structure for a connector that can shorten the dimension of a terminal in the fitting direction in comparison with the related art is provided.

DETAILED DESCRIPTION

Figure 5:
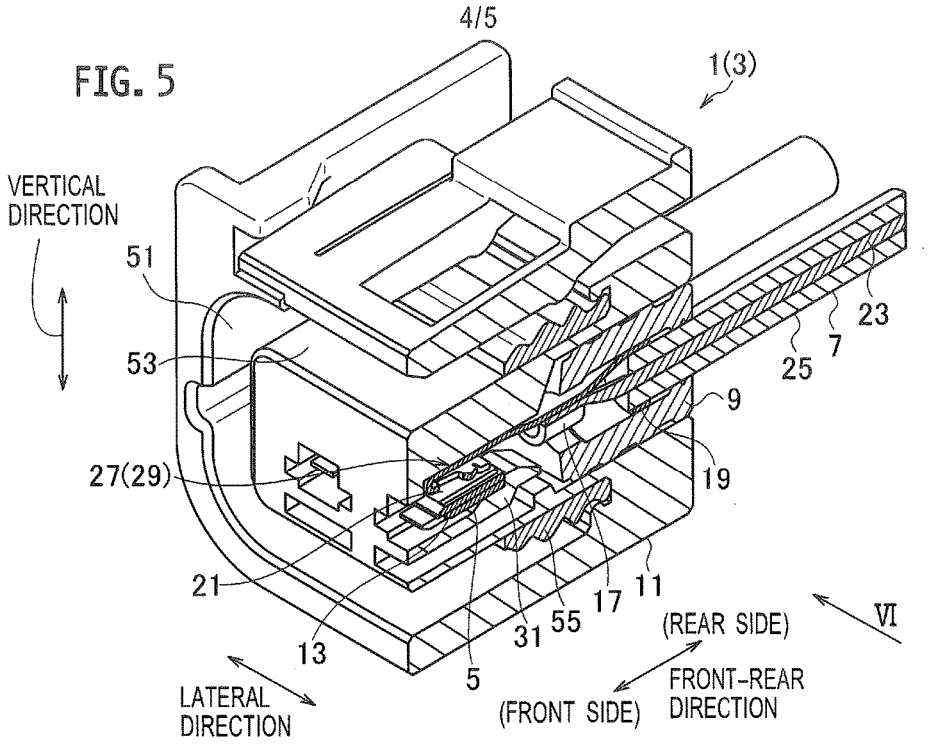
FIG. 5 is a perspective view, with a partial cross-section, showing a schematic configuration of a water-stop structure for a connector according to an embodiment of the present invention.
Figure 6:
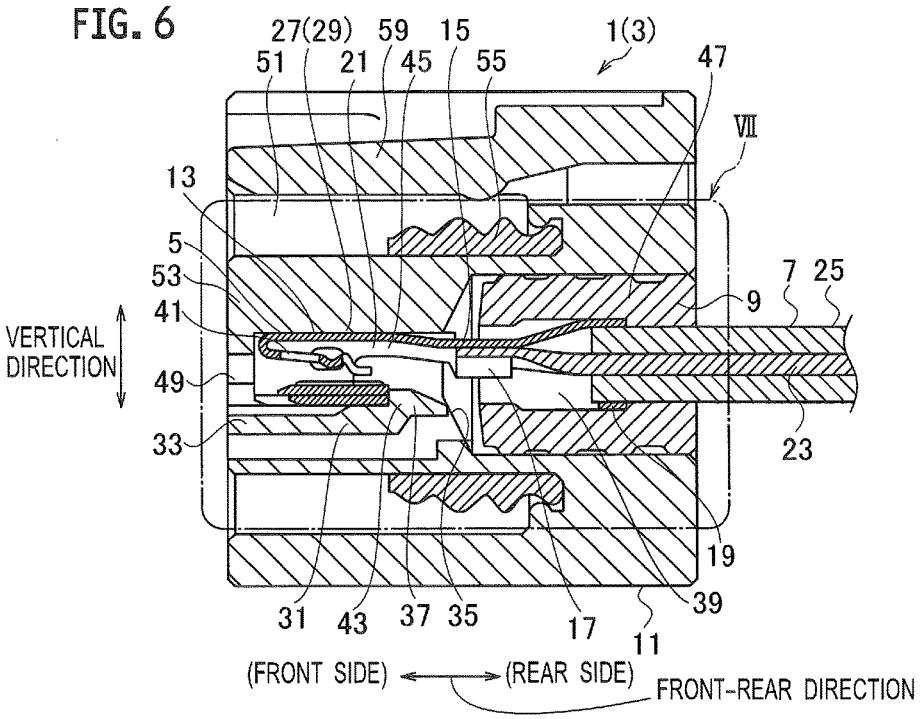
FIG. 6 is a view as seen from the direction of an arrow VI in FIG. 5.
Figure 7:
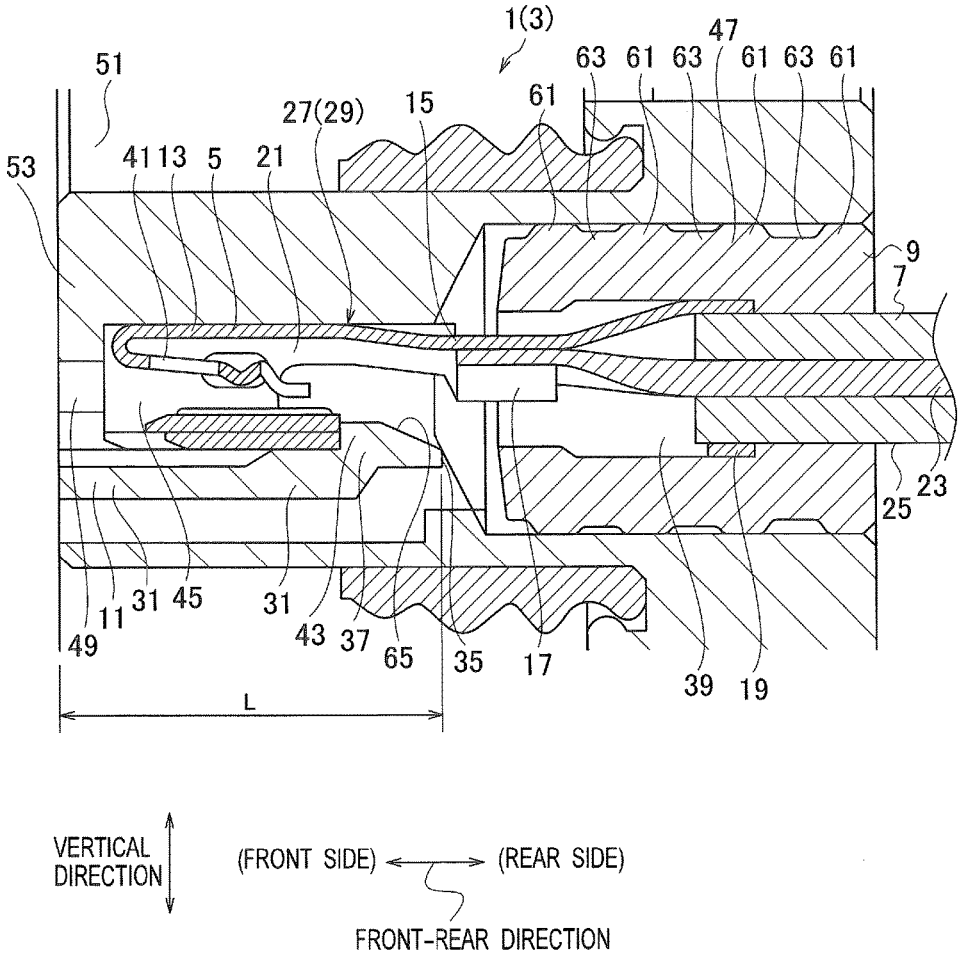
FIG. 7 is an enlarged view of a VII portion in FIG. 6.

A water-stop structure for connector 1 according to an embodiment of the present invention is adopted in a connector 3, and includes a terminal (such as a female terminal) 5, an electric wire 7, a sealing body (sealing member) 9, and a housing 11 as shown in FIGS. 5 to 7.

The terminal 5 includes a mating terminal connecting portion (box-shaped portion or the like) 13 connecting to a mating terminal (such as a male terminal), a coupling portion 15, a wire barrel portion (core wire caulking holding portion) 17, and an insulation barrel portion (sheath caulking holding portion) 19. The mating terminal connecting portion 13, the coupling portion 15, the wire barrel portion 17, and the insulation barrel portion 19 are connected to each other in this order from the front side toward the rear side in a front-rear direction.

The wire barrel portion 17 and the insulation barrel portion 19 are apart from each other in the front-rear direction (a cutout is formed between the wire barrel portion 17 and the insulation barrel portion 19) in the embodiment. However, the wire barrel portion 17 and the insulation barrel portion 19 may be connected to each other in the front-rear direction.

For the convenience of explanation, an insertion direction of the terminal 5 when installing the terminal 5 in a cavity (terminal storage portion) 21 provided in the housing 11 is referred to as the front-rear direction. In addition, a predetermined direction perpendicular to the front-rear direction is referred to as a lateral direction. A direction perpendicular to the front-rear direction and to the lateral direction is referred to as a vertical direction.

The electric wire 7 includes a core wire 23, and a sheath (insulating cover) 25 that cover the core wire 23. At one end portion of the electric wire 7 in the longitudinal direction (front end portion in the front-rear direction), the sheath 25 is removed and thus, the core wire 23 is exposed.

At least a portion of the exposed core wire 23 is surrounded and held by the wire barrel portion 17. In addition, a portion of the sheath 25 near the exposed core wire 23 is surrounded and held by the insulation barrel portion 19. Accordingly, the terminal 5 is installed on the electric wire 7 (the electric wire 7 is installed on the terminal 5).

The sealing body 9 is integrally provided on the electric wire 7 and the terminal 5 using a mold or the like so as to cover the insulation barrel portion 19 that holds at least the electric wire 7 and to cover a portion of the electric wire 7 near the insulation barrel portion 19.

In an electric wire with terminal (electric wire holding terminal) 27, the core wire 23 of the electric wire 7 is held by the wire barrel portion 17, and the sheath 25 of the electric wire 7 is held by the insulation barrel portion 19. In the electric wire with terminal 27, the electric wire 7 extends from the opposite side of the mating terminal connecting portion 13 (rear side of the terminal 5) toward the rear side in the front-rear direction.

A terminal with electric wire provided with the sealing body 9 (sealing body-installed electric wire with terminal 29) is inserted into the cavity 21 of the housing 11, behind the mating terminal connecting portion 13 while passing the wire barrel portion 17, the insulation barrel portion 19, and the electric wire 7. The sealing body-installed electric wire with terminal 29 is installed in the housing 11 so that the outer periphery of the sealing body 9 comes into contact with a predetermined portion of the inner periphery of the cavity 21 of the housing 11. The water-stop structure for connector 1 is configured so that the housing 11 and the sealing body 9 are sealed in accordance with such contact.

A lance 31 is provided in the housing 11. The lance 31 engages with the sealing body-installed electric wire with terminal 29 accommodated in the cavity 21 so as to retain the sealing body-installed electric wire with terminal 29.

The lance 31 is a portion of the housing 11. The lance 31 is formed in a cantilevered manner and extends in the front-rear direction.

In an insertion direction (front-rear direction) of the sealing body-installed electric wire with terminal 29, a base end 33 of the lance 31 is positioned apart from the sealing body-installed electric wire with terminal 29 accommodated in the cavity 21, and at the front side of the sealing body-installed electric wire with terminal 29.

In the insertion direction (front-rear direction) of the sealing body-installed electric wire with terminal 29, a tip end 35 of the lance 31 is positioned behind the base end 33. A locking portion 37 is provided on a tip end portion (rear end portion) of the lance 31.

Accordingly, the lance 31 is configured so as to retain the terminal 5 as described above by engaging the locking portion 37 with the mating terminal connecting portion 13 of the sealing body-installed electric wire with terminal 29 accommodated in the cavity 21.

The sealing body 9 is integrally provided on the electric wire 7 and the terminal 5, at a portion from the wire barrel portion 17 to the electric wire 7 near the insulation barrel portion 19, so as to cover the wire barrel portion 17, the insulation barrel portion 19, and the portion of the electric wire 7.

In FIGS. 6 and 7, a gap 39 is shown between the sealing body 9 and the wire barrel portion 17. However, the gap 39 may be eliminated, and the sealing body 9 may be in close contact with the terminal 5 and to the electric wire 7 at the portion from the wire barrel portion 17 to the electric wire 7 near the insulation barrel portion 19.

In a state where the sealing body-installed electric wire with terminal 29 is accommodated in the cavity 21 and where the terminal 5 is retained by the lance 31, the tip end (rear end) of the lance 31 and the sealing body 9 are slightly apart from each other in the front-rear direction.

Specifically, for example, in the front-rear direction, a front end of the sealing body 9 is positioned at a front end (alternatively, a middle portion) of the wire barrel portion 17, and a rear end thereof is positioned at the sheath 25 which is slightly to the rear side of the insulation barrel portion 19. In the state where the sealing body-installed electric wire with terminal 29 is accommodated in the cavity 21 and where the terminal 5 is retained by the lance 31, the sealing body-installed electric wire with terminal 29 is positioned at the furthest in the front side of the housing 11, and the rear end of the lance 31 and the front end of the sealing body 9 are slightly apart from each other by about the dimension of the coupling portion 15 in the front-rear direction.

The water-stop structure for connector 1 will be described more specifically.

The terminal 5 is formed of a plate-like material made of an electrically conductive material such as a metal. Such plate-like material is shaped into a predetermined shape, and appropriately bent to be formed into the terminal 5. The mating terminal connecting portion 13 has a rectangular-tube shape. An elastic piece 41 is provided inside the rectangular tube. A cutout 43 where the locking portion 37 of the lance 31 engages is provided on one of four side wall portions of the mating terminal connecting portion 13.

The wire barrel portion 17 is formed in a pair. In the electric wire with terminal 27, the wire barrel portion 17 surrounds the exposed portion of the core wire 23 where the sheath 25 is removed. The insulation barrel portion 19 is formed in a pair. In the electric wire with terminal 27, the insulation barrel portion 19 covers most of the entire outer periphery of the sheath 25 of the electric wire 7 at a portion slightly behind the front end of the sheath 25.

The housing 11 is, for example, integrally formed of an insulating material such as a synthetic resin. The cavity 21 is recessed frontward from the rear end of the housing 11, and includes a front portion 45 and a rear portion 47. The front portion 45 is formed in a square columnar shape, substantially the same shape as the outer shape of the mating terminal connecting portion 13 of the terminal 5. The rear portion 47 is formed in a cylindrical shape. A central axis of the front portion 45 and a central axis of the rear portion 47 are the same. The inner diameter of the rear portion 47 is larger than the outer diameter of the square-pillar shaped front portion 45 (for example, the length of a diagonal line of a rectangular-shaped bottom surface of the square column).

The lance 31 is provided on one of side wall portions of the front portion 45. In the front-rear direction, the position of the tip end (rear end) of the lance 31 and the position of the rear end of the front portion 45 are substantially the same. A through hole 49 is formed between the front end of the front portion 45 (bottom of the cavity 21) and the front end of the housing 11.

A tube-shaped recessed portion 51 is provided in the housing 11. The recessed portion 51 is formed to be recessed from the front end toward the rear side of the housing 11. The recessed portion 51 is provided and thus, a projected portion 53 is formed in the housing 11. The cavity 21 and the lance 31 are positioned at an inner side of the projected portion 53. An annular packing 55 is installed on the outer periphery of the projected portion 53. An elastic arm 59 is provided on the outer side of the tube-shaped recessed portion 51.

When a mating connector (not shown) with a terminal (such as a male terminal) is installed in the housing 11 (connector 3) with the sealing body-installed electric wire with terminal 29, accordingly, the mating connector enters the recessed portion 51 and engages with the packing 55 and the elastic arm 59. Thereafter, the mating connector is retained so as not to slip off from the connector 3 while the connector 3 and the mating connector are sealed.

Moreover, when the mating connector with the terminal is installed in the connector 3, accordingly, the terminal of the mating terminal passes through the through hole 49 of the housing 11 and enters the mating terminal connecting portion 13 of the terminal 5. Thereafter, the terminal of the mating connector and the terminal 5 are connected.

The sealing body 9 is, for example, integrally formed of an insulating material such as a synthetic resin (including rubber). However, the elastic modulus of the sealing body 9 is smaller than that of the housing 11. In addition, the sealing body 9 is easily deformed elastically in comparison with the housing 11.

The outer diameter of the sealing body 9 is, for example, formed in a cylindrical shape, substantially the same shape as the rear portion 47. A central axis of the sealing body 9 and a central axis of the electric wire 7 are the same. More specifically, in the sealing body 9, a large-diameter portion 61 and a small-diameter portion 63 are alternately formed in the front-rear direction (extending direction of a central axis of a cylinder).

The outer diameter of the large-diameter portion 61 is slightly larger than the inner diameter of the rear portion 47 of the cavity 21. The outer diameter of the small-diameter portion 63 is slightly smaller than the inner diameter of the rear portion 47 of the cavity 21.

When the sealing body-installed electric wire with terminal 29 is installed in the housing 11, the large-diameter portion 61 is pushed by the pressure of the inner wall of the rear portion 47. Accordingly, the sealing body-installed electric wire with terminal 29 and the housing 11 are sealed. As a result, the sealing body 9 can function similar to those of the conventional sealing member 309 and rubber plug 359.

The manufacture of the sealing body-installed electric wire with terminal 29 will be described. The sheath 25 of the electric wire 7 is appropriately removed to expose the core wire 23 at one end portion. Thereafter, the terminal 5 is installed on the electric wire 7, and the sealing body 9 is in close contact with the terminal 5 and the electric wire 7 using a mold or the like so as to be integrally installed.

Next, an installation of the sealing body-installed electric wire with terminal 29 to the housing 11 will be described.

As an initial state, the sealing body-installed electric wire with terminal 29 is behind the housing 11 and apart from the housing 11. In such state, the front side of the sealing body-installed electric wire with terminal 29 is the mating terminal connecting portion 13, and the rear side of the sealing body-installed electric wire with terminal 29 is the electric wire 7. In addition, in the lateral direction and the vertical direction, the position of the cavity 21 and the position of the sealing body-installed electric wire with terminal 29 are the same.

In the initial state described above, when the sealing body-installed electric wire with terminal 29 moves to the front with respect to the housing 11, the terminal 5 enters the cavity 21, and the tip end of the terminal 5 abuts against an inclined surface 65 of the tip end portion of the lance 31. When the tip end side (rear side) of the lance 31 in FIGS. 6 and 7 elastically deforms downward and bends, the sealing body 9 starts entering the rear portion 47 of the cavity 21.

When the sealing body-installed electric wire with terminal 29 moves further to the front, the front end of the terminal 5 abuts against the bottom (front end surface) of the cavity 21, and the lance 31 is restored. In such state, the locking portion 37 of the lance 31 enters the cutout 43 of the mating terminal connecting portion 13 so as to retain the sealing body-installed electric wire with terminal 29. Thereafter, the sealing body 9 enters the rear portion 47 of the cavity 21 so as to seal (water-stop) the housing 11 and the sealing body 9.

Figure 1:
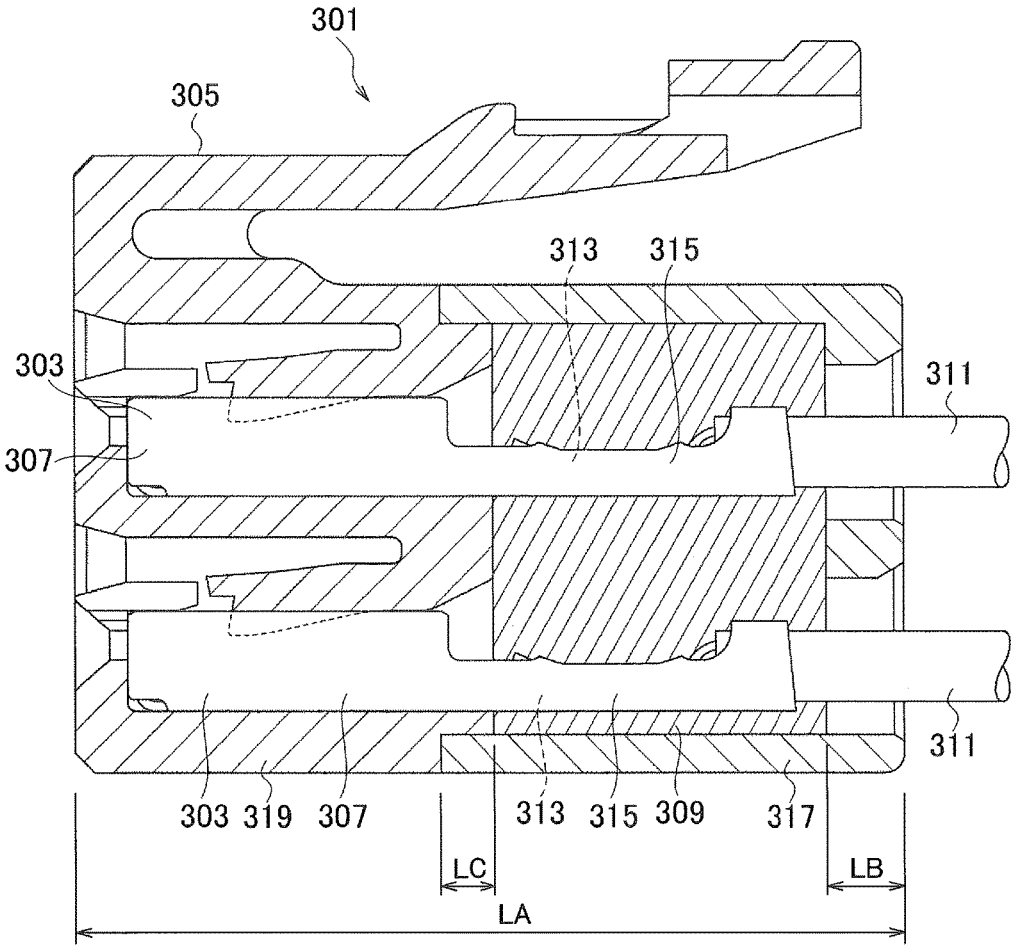
FIG. 1 is a view showing a conventional water-stop structure for a connector.
Figure 2:
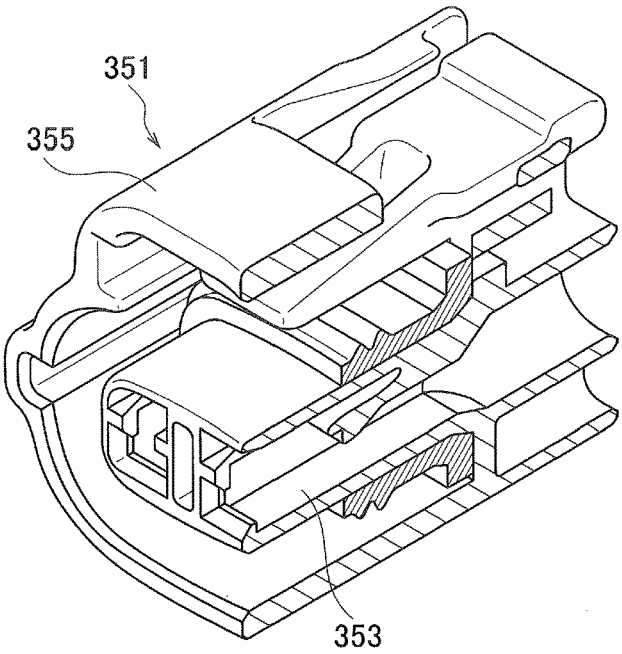
FIG. 2 is a view showing a conventional water-stop structure for a connector.
Figure 3:
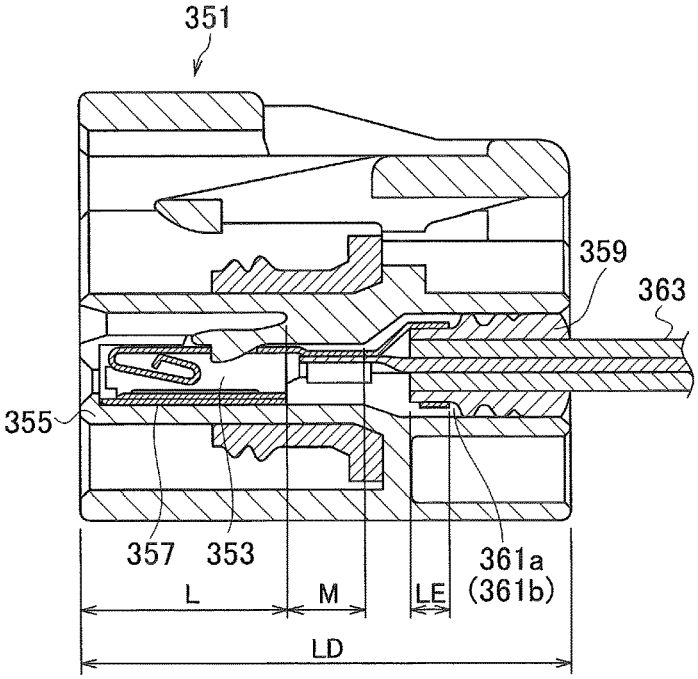
FIG. 3 is a view showing the conventional water-stop structure for a connector.

According to the water-stop structure for connector 1, the sealing body 9 is integrally provided on the electric wire 7 and the terminal 5 so as to cover the insulation barrel portion 19. Therefore, the water-stop structure for connector 1 does not need to provide a portion for fixing the sealing body 9 to the housing 11 and to the terminal 5. Accordingly, the dimensions LB and LC in the conventional water-stop structure for connector 301 (see FIG. 1), and dimension LE in the conventional water-stop structure for connector 351

(see FIG. 4) can be set to zero. In addition, the dimension of the terminal 5 in the fitting direction (front-rear direction) can be set smaller than that of the related art.

According to the water-stop structure for connector 1, the lance 31 is formed in a cantilevered manner. Moreover, the base end of the lance 31 is positioned at the front side in the insertion direction of the terminal 5, and the tip end of the lance 31 is positioned behind the base end in the insertion direction of the terminal 5. The locking portion 37 provided on the side of the tip end of the lance 31 engages with the mating terminal connecting portion 13 of the terminal 5 accommodated in the cavity 21 so as to retain the terminal 5. Accordingly, the water-stop structure for connector 1 can set the dimension of the terminal 5 in the fitting direction to be smaller than that of the related art.

Figure 4:
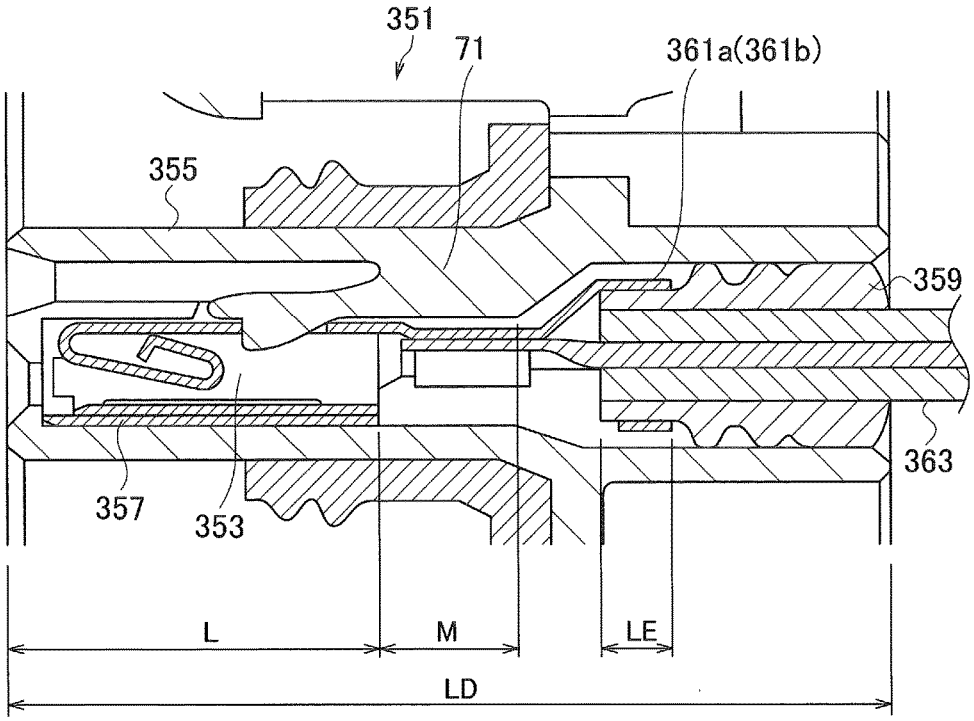
FIG. 4 is a view showing the conventional water-stop structure for a connector.

Description will be made in detail. In the conventional water-stop structure for a connector, as shown in FIG. 4, a base end of a lance formed in a cantilevered manner is positioned at the rear side, and a tip end of the lance is positioned at the front side. Moreover, the lance bends when a terminal is inserted into a cavity of a housing. Therefore, in order to secure the strength of a fulcrum portion (base end portion) 71 of the lance, it is necessary that the length of the fulcrum portion 71 of the lance be increased to some extent. In addition, the distance of a dimension M of the terminal in the fitting direction is required in order to avoid interference between the fulcrum portion 71 and a sealing member.

In contrast, in the water-stop structure for connector 1, as described above, the base end of the lance 31 is positioned at the front side, and the tip end of the lance 31 is positioned behind the base end. Therefore, a fulcrum portion of the lance 31 can be provided on the front end portion (front side near the terminal 5 inserted into the cavity 21 of the housing 11) of the housing 11. In addition, the sealing body 9 can be positioned right behind the mating terminal connecting portion 13 (dimension L-portion) as shown in FIG. 6. Moreover, the dimension M shown in FIG. 4 can be set to zero. As a result, the dimension of the terminal 5 in the fitting direction (front-rear direction) can be set even smaller than that of the related art.

According to the water-stop structure for connector 1, the sealing body 9 is provided on the electric wire 7 and the terminal 5, at the portion from the wire barrel portion 17 to the electric wire 7 near the insulation barrel portion 19, so as to cover the wire barrel portion 17, the insulation barrel portion 19, and the portion of the electric wire 7. As a result, the sealing body 9 is in close contact with an electric wire connecting portion (portion where the terminal 5 and the electric wire 7 are connected to each other) while covering the core wire 23 of the electric wire 7. Therefore, the connecting portion between the terminal 5 and the electric wire 7 (such as a connecting portion between the wire barrel portion 17 of the terminal 5 and the core wire 23 of the electric wire 7) is liquid-tightly sealed. Accordingly, the connection reliability between the electric wire 7 and the terminal 5 is secured. In addition, the entering of water or the like from the end portion of the terminal 5 into the space between the sheath 25 and the core wire 23 of the electric wire 7 is prevented.

Although the embodiment of the present invention has been described heretofore, the embodiment is merely exemplified for facilitating the understanding of the present invention, and the present invention is not limited to the embodiment. The technical scope of the present invention may include not only the specific technical matters disclosed in the above-described embodiment but also various modifications, changes, and alternative techniques easily derived from the above-described specific technical matters.

What is claimed is:

1. A water-stop structure for a connector comprising:

a terminal including a mating terminal connecting portion, a wire barrel portion, and an insulation barrel portion;

an electric wire installed on the terminal in such a manner that a sheath is removed to expose a core wire at one end portion, the exposed core wire is held by the wire barrel portion, and a portion of the sheath near the exposed core wire is held by the insulation barrel portion;

a sealing body integrally provided on the electric wire and the terminal so as to cover at least the insulation barrel portion;

a housing provided with a cavity into which the terminal is inserted in a forward insertion direction extending from a rear side of the housing to a forward side of the housing and accommodated in the cavity; and a lance that is provided in the housing, and engages with the terminal accommodated in the cavity to retain the terminal, wherein the lance is formed in a cantilevered manner, a base end of the lance is positioned at the forward side in the insertion direction of the terminal, a tip end of the lance is positioned at the rear side in the insertion direction of the terminal, and a locking portion provided on the side of the tip end engages with the mating terminal connecting portion of the terminal accommodated in the cavity so as to retain the terminal, wherein the cavity includes a front portion so as to accommodate the mating terminal connecting portion and a rear portion, and the rear portion of the cavity has a diameter larger than a diameter of the front portion of the cavity, wherein the lance is provided on one of side wall portions of the front portion, and a distal end of the tip end of the lance is positioned at a rear end of the front portion of the cavity.

2. The water-stop structure for a connector according to claim 1, wherein the sealing body is integrally provided on the electric wire and the terminal, at a portion from the wire barrel portion to the electric wire near the insulation barrel portion, so as to cover the wire barrel portion, the insulation barrel portion, and a part of the electric wire.

3. The water-stop structure for a connector according to claim 1, wherein the sealing body contacts with an inner surface of the cavity and seals a space between the housing and the terminal or the electric wire.

4. The water-stop structure for a connector according to claim 1, wherein the sealing body comprises a large diameter portion and a small diameter portion which are alternately formed.

5. The water-stop structure for a connector according to claim 1, wherein the elastic modulus of the sealing body is smaller than the elastic modulus of the housing.

6. The water-stop structure for a connector according to claim 1, wherein the rear portion of the cavity has a constant diameter, and wherein a diameter at a rear end part of the front portion of the cavity is expanded.

7. The water-stop structure for a connector according to claim 6, wherein the tip end of the lance is arranged in the rear end part of the front portion.

* * * * *